United States Patent [19]

Sun

[11] Patent Number: 4,883,224

[45] Date of Patent: Nov. 28, 1989

[54] ASHTRAY APPARATUS

[76] Inventor: Shin-Ching Sun, 3F., No. 32, 132nd Lane, Hu-Lin St., Taipei, Taiwan

[21] Appl. No.: 197,134

[22] Filed: May 18, 1988

[51] Int. Cl.[4] ..... A42F 19/00

[52] U.S. Cl. ..... 232/43.1; 131/231; 131/240.1

[58] Field of Search ..... 232/43.1; 131/231, 240.1

[56] References Cited

U.S. PATENT DOCUMENTS 4,726,513 2/1988 Wolfe ..... 232/43.1

4,828,165 5/1989 Watai et al. ..... 232/43.1

*Primary Examiner*—Robert W. Gibson, Jr.

*Attorney, Agent, or Firm*—Browdy and Neimark

[57] ABSTRACT

An ashtray apparatus comprises a seat having a top rim which provides to place or contain an ashtray and of which inside center is hollow to contain a PC board and batteries, a support rod of which low end is connected a cage cover and also supports it, a cage cover fixing a negative ion emitting needle device and providing a positive ion dust collecting film, a negative ion emitting needle device fixed at the open of said cage cover and a positive ion dust collecting film united on the inner rim of said cage cover. By the connection of aforesaid elements that makes the particle cigarette ashes floating in the smoke through the adherence of negative ion be absorbed and adhered by the positive ion collecting film and be eliminated to reduce the air pollution of inside.

7 Claims, 3 Drawing Sheets

ASHTRAY APPARATUS

BACKGROUND OF THE INVENTION

1. Field of the Invention

The present invention relates to an ashtray apparatus, in particular, an ashtray apparatus which can eliminate the particle cigarette ashes and dust floating in the smoke from the burning cigarette in the ashtray. This can reduce the pollution of the inside air.

2. The Prior Art

Nowa-days, the function of a conventional ashtray is only to receive the cigarette ashes and butt and the burning cigarette, no matter whether the ashtray is made from plastics, glass or china and no matter how it is formed. Some of the ashtrays do not have any other functions except that some of them are designed to be beautiful to ornament the decor. The smoker however is used to inhaling and then placing the burning cigarette on the rim of the ashtray. Particularly when the smoker is in the working environment, he may let the cigarette burn itself down and extinguish it in the ashtray. This condition greatly pollutes the inside air. Therefore, there is a kind of ashtray device designed to draw the smoke in and then to discharge it. Although it can reduce the pollution of inside air, a cigarette may burn up more quickly than normal and be waste readlly because of the drawing function of the ashtray.

OBJECTS OF THE INVENTION

The objects of the present invention is to slove the aforesaid defects of conventional ashtrays and the ashtray devices. The present invention provides a new designed ashtray apparatus which has the following characteristics.

The present invention provides a negative ion producing device to eliminate the particle cigarette ashes and dust produced by the smoke in the ashtray, and to reduce the air pollution of the inside air.

The present invention does not have any influence on the burning cigarette and does not cause the cigarette to increase its speed of burning.

SUMMARY OF THE INVENTION

According to one aspect of the invention, an ashtray apparatus comprises a seat having a top rim which forms an ashtray and a PC board and batteries contained inside, a support rod having a low end low end connected to the seat and a top end connected to a cage cover. The cage cover fixedly holds a negative emitting needle device and provides a positive ion dust collecting film is connected with said cage cover, a negative ion emitting needle device fixed at the open of said cage cover and a positive ion dust collecting film united on the inner rim of said cage cover. The present invention can make the particle cigarette ashes which are produced from the burning cigarette in the ashtray adhere to the positive ion dust collecting film of the inner rim of said cage cover to significantly reduce the air pollution of the room.

SPECIFIC DESCRIPTION

Figure 1:
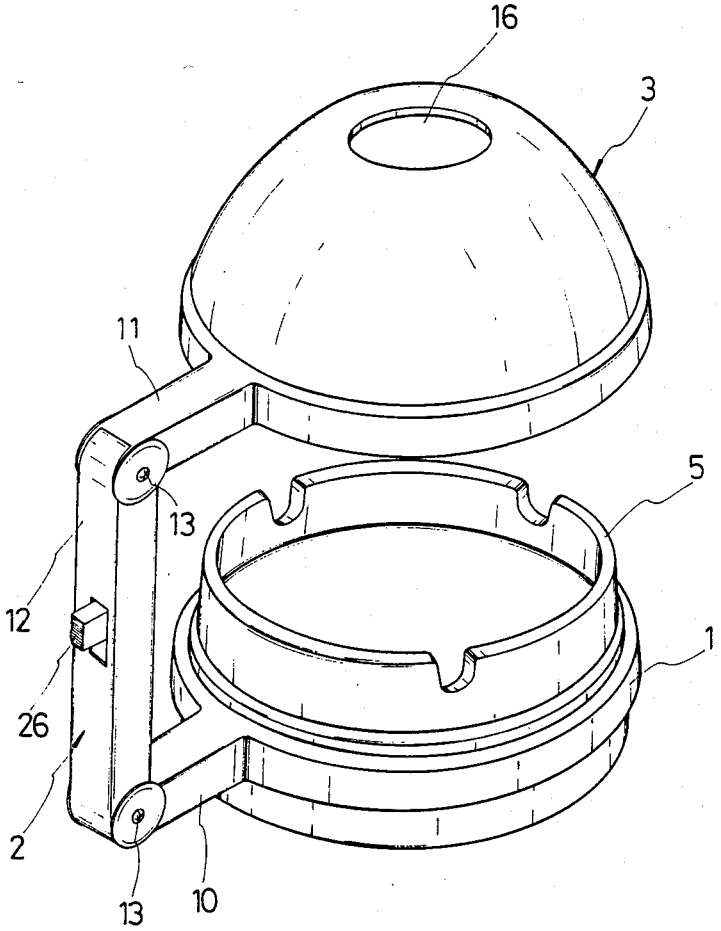
FIG. 1 is a a perspective view of the structure in accordance with the present invention.
Figure 2:
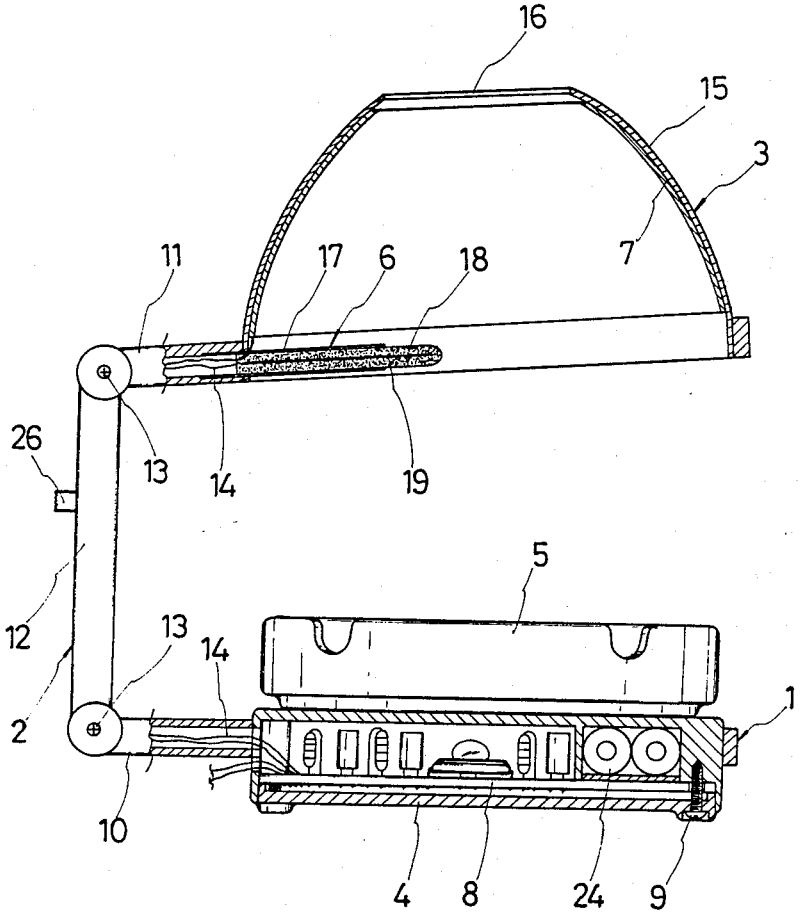
FIG. 2 is a partial cut-away view of inner structure of FIG. 1.

Relating to FIGS. 1 and 2, present invention comprises seat 1, support rod 2, cage cover 3, PC board 4, ashtray 5, negative ion emitting needle device 6, positive ion dust collecting film 7 and batteries 24. The seat 1, of which the inside center is hollow, can be formed as a circle, square or other suitable polygon. The top rim of seat 1 is a plane or has some suitable concave surface to receive any kind of conventional ashtray, and the open bottom end of seat 1 containing PC board 8 and batteries 5 is covered and locked by cover board 4 and screw bolts 9. Support rod 2 is connected with cage cover 3 at the perimeter of the seat 1. The support rod 2 is combined with two same horizontal rods 10, 11 and a straight rod 12 by screw bolts 13. The center of each of the rods receives therethrough the circuit connecting wire 14 of PC board 8 to connect emitting needle 19 of negative ion emitting needle device 6 and positive ion dust collecting film 7. Besides, support rod 2 can be adjusted to change the position and angle of cage cover 3 by the application of external force. The cage coverr 3 is fixed on the ring part of top horizontal rod 11 of support rod 2, which is a semi-circular cage or other suitable arc-shaped cage body 15 adapted to the form of ashtray 5. The cage body 15 is made from some insulated material and its inner rim covers or coats a layer of conductive material which becomes positive ion dust collecting film 7. At the top of cage cover 3 there is a discharge hole 16. The ascending smoke filled with particle cigarette ashes is managed by the negative ions emitted from negative ion emitting needle device 6 of the cage cover. Wherein, the particle cigarette ashes and dust are adhered with the negative ion and absorbed by positive ion dust collecting film 7. Then, the clean air is discharged from the discharge hole 16. The negative ion emitting needle device 6 is combined in the housing pipe 17 of cage cover 3, and that housing pipe 17 is inserted in the openings of top horizontal rod 11 and the cage cover 3. Negative ion emitting needle device 6 is composed of housing pipe 17, sponge 18 and emitting needle 19. The housing pipe 17 is a small insulated pipe, which is provided in the cross hold of top horizontal rod 11, straight rod 12 and the ring rod. Sponge 18 coats completely the whole emitting needle 19 and most of the sponge 18 and needle 19 are inserted in the housing pipe 17. The end of the needle 19 connects wire 14, and its point continuously emits negative ions by the circuit action of PC board.

Figure 3:
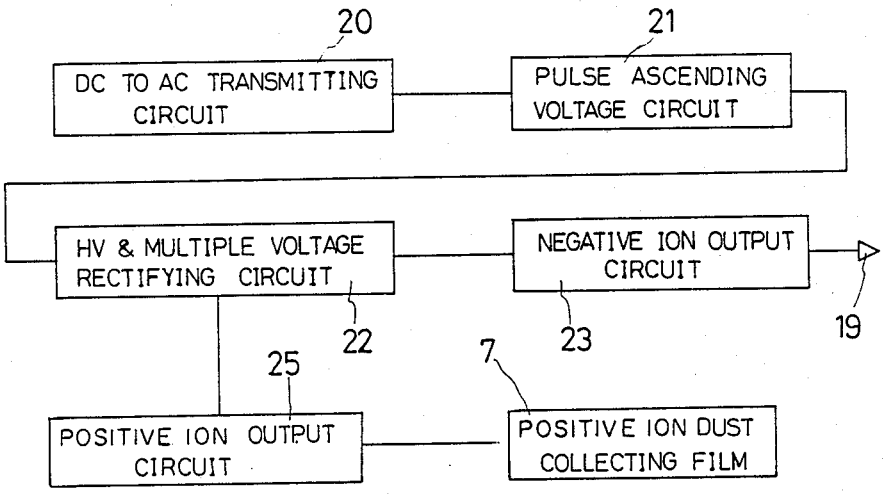
FIG. 3 is a block diagram of the circuit of the present invention.
Figure 4:
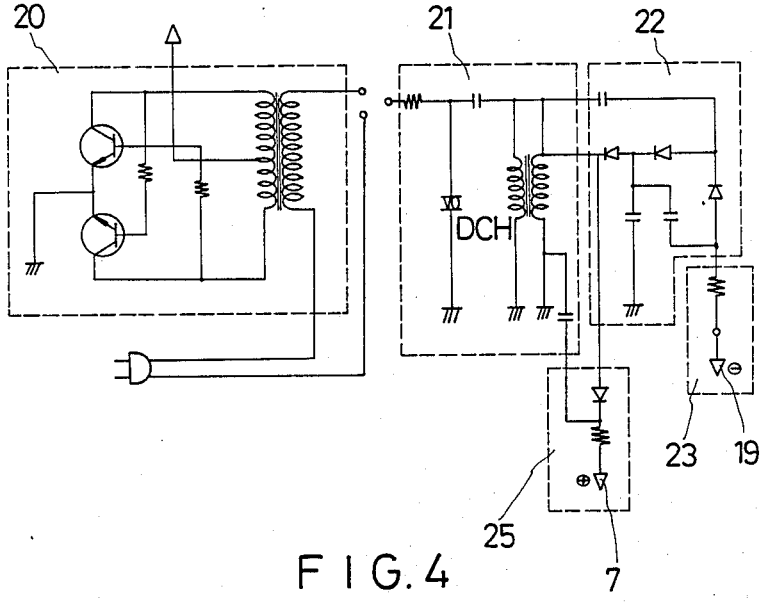
FIG. 4 is a circuit view of the embodiment of the present invention.

Referring to FIGS. 3 and 4, block diagram of the circuit of PC board and a circuit view of the embodiment in accordance to present invention are shown in view of DC to AC transmitting circuit 20, the present invention can be used directly with the general inside AC source. Batteries 24 can also be used to raise the voltage by what the transmitting circuit 20 provides to pulse ascending voltage circuit 21. After the rise of the pulse ascending voltage circuit 21, the circuit is rectified multiple voltage by HV & multiple voltage rectifying circuit 22 to make negative ion output circuit 23 produce the negative ions. Then, the negative ion emitted continualy from emitting needle 19. At that time, the positive electricity is transmitted to the positive ion dust collecting film 7 to absorb the cigarette ashes and dust which are adhered to the negative ions.

The user need only turn on source switch 26 to use the present invention. Then, the negative ions are produced by the PC board 8 and continously emitted by emitting needle 19 and adhered on the floating particle cigarette ashes of the ascending smoke in ashtray 5. The floating particle cigarette ashes which are adhered to the negative ions are absorbed by positive ion dust collecting film 7. The ascending smoke is thus continuously managed with the negative ions and absorbed and adhered by positive ion dust collecting film 7 during the process of circling under the cage cover 3. When the smoke is discharged from discharge hole 16, the floating particle cigarette ashes have been already managed and eliminated and is discharged through hole 16 clean air to reduce the air pollution of the room.

I claim:

1. An ashtray apparatus comprising:

a seat having an upper surface adapted to receive an ashtray and defining a hollow space adapted to receive a PC board and at least one battery;

a cage cover adjustably connected to said seat and having an open end opened towards said seat;

a negative ion emitting needle device fixed at the open end of said cage cover and having one end connected to a negative ion output circuit of the PC board;

a positive ion dust collecting film fixed with said cage cover; and wherein particle cigarette ashes from smoke produced from a burning cigarette in the ashtray adheres to said positive ion dust collecting film responsive to operation of said negative ion emitting needle device.

2. The ashtray apparatus of claim 1, wherein said seat is formed in a circle, square or other polygonal shape.

3. The ashtray apparatus of claim 1, wherein said upper surface of said seat is planar.

4. The ashtray apparatus of claim 1, wherein said upper surface of said seat is concave.

5. The ashtray apparatus of claim 1, further comprising connecting rod means for adjustably connecting said cage cover to said seat and wire means for connecting said negative ion emitting needle device and said positive ion dust collecting film to the PC board.

6. The ashtray apparatus of claim 5, wherein said negative ion emitting needle device comprises an insulated housing pipe inserted into said connecting rod means, an emitting needle for emitting negative ions and a sponge coating completely substantially the entire needle and inserted into said pipe.

7. The ashtray apparatus of claim 6, wherein the PC board comprises a pulse ascending voltage circuit;

a HV & multiple voltage rectifying circuit connected to an output of said pulse ascending voltage circuit;

a negative ion circuit connected to an output of said rectifying circuit and responsive thereto for producing negative ions and continuously emitting the negative ions from the emitting needle; and positive ion output circuit connected to said rectifying circuit for transmitting positive electricity to said positive ion dust collecting filon to absorb dust adhered to the negative ions.

* * * * *